United States Patent [19]

Takagiwa et al.

[11] Patent Number: 4,623,604

[45] Date of Patent: Nov. 18, 1986

[54] TRIBOELECTRIC STABILIZED TONER FOR DEVELOPING ELECTRICALLY CHARGED IMAGES AND A METHOD FOR THE PRODUCTION THEREOF

[75] Inventors: Hiroyuki Takagiwa; Kenzi Thuzita; Goichi Yamakawa; Makoto Tomono, all of Hachioji; Saburo Wakimoto, Kanagawa; Sadayasu Miyahara, Fujisawa; Tetsumasa Ishida, Yokohama; Yoshihiko Hyosu, Sagamihara; Tsuneo Wada, Hachioji, all of Japan

[73] Assignee: Konishiroku Photo Industry Co., Ltd., Tokyo, Japan

[21] Appl. No.: 695,408

[22] Filed: Jan. 25, 1985

Related U.S. Application Data

[63] Continuation of Ser. No. 473,977, Mar. 11, 1983, abandoned, which is a continuation of Ser. No. 259,578, May 1, 1981, abandoned.

[30] Foreign Application Priority Data

May 2, 1980 [JP] Japan ..... 55-57927
May 2, 1980 [JP] Japan ..... 55-57928

[51] Int. Cl.[4] ..... G03G 9/08

[52] U.S. Cl. ..... 430/109; 430/110; 430/137

[58] Field of Search ..... 430/109, 110, 137

[56] References Cited

U.S. PATENT DOCUMENTS

| | | | |
|---|---|---|---|
| 3,720,617 | 3/1973 | Chatterji et al. | 430/110 |
| 4,016,099 | 4/1977 | Wellman et al. | 430/137 |
| 4,077,804 | 3/1978 | Vanzo | 430/137 |
| 4,288,517 | 9/1981 | Arimatsu et al. | 430/110 |

*Primary Examiner*—John L. Goodrow
*Attorney, Agent, or Firm*—Jordan B. Bierman

[57] ABSTRACT

Toner for developing electrostatically charged images comprising nuclear particles formed by polymerization, hydrophobic silica, and a resin, wherein said resin is coated on said nuclear particles and said silica is dispersed in said resin. A method for producing said toner is also disclosed, said method comprising polymerizing nuclear particles, dissolving a resin in a solvent, which asserts a lesser solvating action against said nuclear particles than against said resin, to form a solution, dispersing said hydrophobic silica in said solution, mixing said nuclear particles with said dispersion, and drying said mixture.

18 Claims, No Drawings

TRIBOELECTRIC STABILIZED TONER FOR DEVELOPING ELECTRICALLY CHARGED IMAGES AND A METHOD FOR THE PRODUCTION THEREOF

This application is a continuation of Ser. No. 473,977, now abandoned filed Mar. 11, 1983, which is a continuation of application Ser. No. 259,578, now abandoned filed May 1, 1981, which in turn claims priority of Japanese Applications Nos. 57928/1980 and 57927/1980, both filed May 2, 1980.

The present invention relates to a toner for developing electrostatically charged images in electrophotography, electrographic recording and electrostatic printing, and to the method for the production thereof.

Conventional methods to develop electrostatically charged images formed on the recording substance in electrophotography, electrographic recording or electrostatic printing etc. roughly include the liquid type developing method wherein the developer in which various types of pigment and dye are dispersed in insulated liquid is used and the so-called dry type developing method wherein fine powder developer, called toner, in which colorant is dispersed in natural or synthetic resin is used Examples of dry type developing methods are cascade method, fur brush method, magnetic brush, impression method and powder cloud method. The present invention relates to the toner used in the latter dry type developing method.

Conventionally, the toner for developing electrostatically charged images is produced as follows: wherein the soft polymer and colorant are melted and mixed and thereby colorant is dispersed in polymer and then the polymer having colorant dispersed therein is pulverized. However, the distribution of the diameters of particles of the fine powder obtained by said production method is extremely broad and for the toner to be put to the practical use, it is necessary to use the classification step further, which gives to said method the drawbacks that the process is eventually complicated and the cost is high.

On the other hand, as a method to obtain colored polymer fine powder directly without including the pulverization step, polymerization methods have been proposed as stated in Japanese Patent Examined Publication Nos. 10231/1961, 14895/1976, 17735/1978, 17736/1978, 17737/1978 and 51830/1972, for example.

These methods are the ones wherein the so-called suspension polymerization method is applied and polymerization composite (composed of polymeric monomer), polymerization starting agent and colorant are suspended and polymerized in an aqueous dispersion medium and thus toner is produced directly. This method has a merit that the particles of toner are spherical in shape and thereby are excellent in fluidity and that the production process is simple and the cost is low.

However, said production method has drawbacks that charge controlling agent that is effective on polymerization reaction cannot be used, or restricted in quantity even in the case it can be used and thus it is not possible to produce the toner having satisfactory charge controllableness. Further, the toner obtained with this method has drawbacks that the toner has a high humidity-dependence and anti-humidity property as well as chargeability thereof are low. These drawbacks are caused by the fact that the dispersion stabilizer that is indispensable to exist in dispersion medium in order to prevent the particle growth caused by the combination of particles of polymerization composite dispersed and suspended in the process of suspension polymerization, exists on the surface of polymer particle produced.

To be concrete, there are roughly two methods as a dispersion stabilizing means in the suspension polymerization method and one of them is a method wherein water-soluble high molecular substance is dissolved in dispersion medium. In this means, the dispersion stabilization effect is obtained with relatively small amount of dispersion stabilizer but due to the fact that said water-soluble high molecular substance adheres to or graft polymerizes on the surface of polymer particle produced, it is difficult to remove completely after the polymerization even if washing is repeated.

Another method is to suspend the less soluble inorganic compound in the dispersion medium. When the less soluble inorganic compound is used independently, the dispersion thereof is insufficient and unstable and therefore it is necessary to conduct the improvement of dispersion and stabilization thereof with a combined use of a surface active agent and this surface active agent is finally contained in polymer particle.

However, this surface active agent, due to its property of surface activity, is extremely hard to be removed completely and it stays on the surface of polymer particle though the amount thereof is small even if it is cleaned using considerable amount of labor and time.

Nevertheless, the electrical property of the toner used in a dry type electrophotography or in an electrographic recoring method is mostly dependent on the property of its surface and due to the fact that such water-soluble high molecular substance or surface active agent stays on the surface of polymer particle, the drawbacks that an electrical conductivity and humidity-dependence of the surface active agent itself exert an influence upon the electrical property of the toner directly and make the triboelectrification property of the toner unstable remarkably, are generated.

The present invention has been invented for the purpose of the conquest of various kinds of drawbacks of the toner made with the pulverization method and polymerization method mentioned above and the object of the present invention is to offer the toner for developing electrostatically charged images having an excellent triboelectrification property and an excellent anti-humidity property.

Another object of the present invention is to offer the toner for developing electrostatically charged images that consists of polymer particles containing colorant uniformly and are substantially spherical and the particle diameter thereof is within a range of 1–50 microns.

Other and further object of the present invention is to offer the method for the production of aforesaid toner for developing electrostatically charged images.

In order to attain the aforesaid objects, the resin solution wherein the resin is dissolved in the less soluble solvent is prepared in the present invention with the polymer particles obtained with polymerization of polymeric monomer and polymerization composite containing colorant as nuclear particles for toner and with the process wherein aforesaid nuclear particles are mixed in said solution and then dried, the resin coated layer is formed on the surface of aforesaid nuclear particles and thus the toner for developing electrostatically charged images is obtained. According to one of the preferred embodiments of the invention the surface of the nuclear particles are dyed with a dye and then coated further with a resin layer.

Further, in order to make the triboelectrification property more stable, the dispersion liquid wherein the hydrophobic silica fine powder is mixed and dispersed in the resin solution obtained by dissolving resin in less soluble solvent is prepared for the nuclear particles for toner obtained with the polymerization of aforesaid polymerization composite, and with the process wherein aforesaid nuclear particles are mixed in said dispersion liquid and dried, resin coated layer having hydrophobic silica on the surface of aforesaid nuclear particles in the state of dispersion is formed and thus the toner for developing electrostatically charged images is obtained.

The method for the production of the nuclear particles for toner stated above will be explained as follows. First, polymeric monomer and polymerization composite wherein colorant is contained as a component are prepared and then aforesaid polymeric monomer is polymerized in the state wherein aforesaid polymerization composite is dispersed and suspended in an aqueous dispersion medium in which dispersion stabilizer exists and thereby the nuclear particles for toner consisting of spherical particle whose diameter is 1–50 microns are produced. In aforesaid polymerization composite, the polymerization starter for aforesaid polymeric monomer, crosslinking agent for the prevention of offset, reactive prepolymer and low molecular weight polyolefin may, as occasion demands, be added and in the case the single component type toner is to be obtained eventually, magnetic substance powder may be added.

In the aforesaid polymerization method, the polymerization is made in the way wherein polymerization composite is dispersed and suspended by mechanical stirring in the dispersion medium like water as dispersion particle with a desired diameter and it is necessary to avoid that dispersion particles increase their stickiness and grow to a big particle with consolidation, and for this purpose, the dispersion stabilizer is used.

Further according to the preferred embodiment of the invention, water soluble, dyes are added and dissolved with agitation into the thusly obtained suspension of nuclear particles for toner use and then acetic acid is added further and the thusly obtained solution is heated and agitated. This is cooled down to room temperature, and solid matter is filtered therefrom and dried up, thus dyed particles are formed. On the other hand, resins are fully dissolved by agitation in a solvent which is hardly soluble against said nuclear particles for toner use, and said nuclear particles are added under agitation in the thusly obtained resin solution, and agitation is kept on until the system thereof is in the uniformly mixed state. Next, the solvent is removed by applying a process for drying said mixture such as air-drying, drying at reduced pressure or mist-drying by a spray-drier, and thus, toner for developing electrostatically charged images, which are dyed with dyes and on which a resin coated layer is formed, are obtained.

In the present invention, anyone of normal type of water soluble dyes can be selected to use as to said dyes, and among those of which the desirable concrete examples thereof can be given as follows: [Lana First Gray 2GL], [Lana First Gray BGL], [Cibalan Gray BL], [Lanyl Olive], [Cibalan Black BGL], [Cibalan Black 2GH], [Kayalan Gray BL], [Lanyl Gray 3B], [Aizen Opal Black BNH], [Aizen Floslan Gray BLH], [Aizen Floslan Gray GLH], [Irgalan Black GBL], [Irgalan Black RBL], [Isolan Black RL], [Isolan Gray BRLS], [Kayakalan Black 2RL], [Kayakalan Black RBL], [Kayakalan Black SLW], [Kayanol Milling Gray GW], [Cosmolan Gray RL], [Cosmolan Black BL], [Kayakalan Gray BRL], [Aizen Cathilon Gray BLH], [Diacryl Super Black BSL], [Sumiacryl Black G], etc. The percentage of amount by weight of each of the above dyes to toner amount in the aggregate is at 0.1–5% by weight, preferably at 1–3% by weight.

The reasons why such improved effects can be obtained when above mentioned dyes are used are that the blackness of toner grains is increased thanks to the fact that the surfaces of nuclear particles are dyed with water soluble dyes and further positive or negative charge controllableness is given in accordance with the kinds of dyes to be used, and, in addition, that the physical property of the surface of coated layer can be improved by suitably selecting resin which forms the coated layer thanks to the fact that the coated layer forms on each surface of nuclear particles in the case of the invention, for example of the said reasons, it is surely achieved that the frictional charge characteristics as well as humidity resistance can be improved by raising the intrinsic volume resistivity to $10^{14}$ Ω.cm or higher.

Such suspension stabilizer used for this purpose may be generally classified roughly into water soluble high molecular substance and fine powder of less soluble inorganic compound and in the former, gelatin, starch, polyvinylalcohol and others are included and in the latter, less soluble salt such as barium sulfate, calcium sulfate, barium carbonate, calcium carbonate and calcium phosphate or the like and inorganic high molecular substance such as talc, clay, cilicic acid and diatomaceous earth or the like and powder of a metallic oxide and others are included. In case dispersed grains are charged in one kind of polarity, either positive or negative, when polymeric composed substance is dispersed in water (with polymeric composed substance containing ionic substance such as nitrogen-containing polymeric monomer for example or cationic substance like less water soluble amine or anionic substance), ionic dispersing agent that will be charged, when dispersed in water, in the polarity on the other side such as negatively-charged colloidal silica or positively-charged aluminum oxide etc. can be effectively used as suspension stabilizer.

In this suspension polymerization, stirring conditions of the suspension are important and they may well exhibit an influence on the grain size of the product and the stability of the polymerization. In order to obtain polymer particles having desirable grain size, which is 1 to 50 microns in diameter, although the size of the particles is affected by various other factors such as viscosity or surface tension of the suspension, it is generally preferable to stir the suspension with the sheering force of $10^3$ to $10^6$ dyne/cm$^2$.

Further, the nuclear particles for toner may be produced in the way wherein colorant and other necessary components are kneaded with polymer obtained with the polymerization of polymeric monomer and then pulverized and classified as occasion demands.

For the nuclear particles thus obtained, resin is dissolved fully in the less soluble solvent by means of stirring and to this resin solution, aforesaid nuclear particles are added while stirring. Stirring is continued until the uniform mixing state is obtained. Then, by means of drying process such as air drying, decompression drying or spray drying by spray drier, the solvent is removed and the toner for developing electrostatically charged images wherein resin coated layer is formed is obtained.

In the case that hydrophobic silica is used in order to further stabilize triboelectrification property, the hydrophobic silica is added to aforesaid resin solution while stirring. It is stirred with the number of revolution of several thousands r.p.m. by "TK Homomixer" etc. Using the dispersion liquid obtained from uniform dispersion in place of aforesaid resin solution, the resin coated layer is formed. Incidentally, the resin coated layer may be formed after the treatment by acid or alkali that follows the completion of polymerization.

As polymeric monomers that can be used in the present invention, styrene monomers such as styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene etc. are given as a preferable one. In addition to this, ethylene unsaturated monoolefin such as ethylene, propylene, butylene and isobutylene etc., vinyl halide such as vinyl chloride, vinylidene chloride, vinyl bromide and vinyl fluoride etc., vinylester such as vinyl acetate, vinyl propionate, vinyl benzoate and vinyl butyrate etc., α-methylene aliphatic monocarboxylic acid ester such as acrylic acid methyl, acrylic acid ethyl, acrylic acid n-butyl, acrylic acid isobutyl, acrylic acid propyl, acrylic acid n-octyl, acrylic acid dodecyl, acrylic acid lauryl, acrylic acid 2-ethylhexyl, acrylic acid stearyl, acrylic acid 2-chloroethyl, acrylic acid phenyl, α-chloroacrylic acid methyl, metacrylic acid methyl, metacrylic acid ethyl, metacrylic acid propyl, metacrylic acid n-butyl, metacrylic acid isobutyl, metacrylic acid n-octyl, metacrylic acid dodecyl, metacrylic acid lauryl, metacrylic acid 2-ethyl hexyl, metacrylic acid stearyl, metacrylic acid phenyl, matacrylic acid dimethyl amino ethyl and metacrylic acid diethylaminoethyl etc., acrylic acid derivative or metacrylic acid derivative such as acrylonitrile, metacrylonitrile, acrylamido etc., vinylether such as vinylmethylether, vinylethylether and vinylisobutylether etc., vinylketone such as vinylmethylketone, vinylhexylketone and methylisopropenylketone etc., N-vinyl compound such as N-vinylpyrrole, N-vinylcarbazole, N-vinylindole and N-vinylpyrolidone etc., vinylnaphthalene and others are given, for example. These monomers can be used either independently or in combination of plural monomers and further, the combination that has polymerization and gives copolymers is also possible.

In the present invention, it is preferable to effect the aforementioned polymerization in the presence of a cross-linking agent which is a compound having two or more polymerizable double bonds in it of which examples are given as such aromatic divinyl compounds as divinyl benzene, divinyl naphthalene and the derivatives thereof, e.g.; diethylene carboxylic acid type esters such as diethylene glycol acrylate, diethylene glycol methacrylate, triethylene glycol methacrylate, trimethylol propane triacrylate, allylmethacrylate, t-butylaminoethyl methacrylate, tetraethylene glycol dimethacrylate, 1,3-butanediol dimethacrylate, ethyleneglycol dimethacrylate, and tetramethylolmethane tetraacrylate; every divinyl compound such as N,N-divinyl aniline, divinyl ether, divinyl sulfide and divinyl sulfone; and compounds having three or more vinyl radicals; every of which can be used singly or mixedly. The mixing ratio of the cross linking agents against polymeric monomers is within the range of 0.005–20% by weight, preferably 0.1–5% by weight.

As reactive prepolymers to be used in the present invention, polybutadiene prepolymers such as butadiene polymer, α,ω-polybutadienehomopolymer, α,ω-polybutadieneglycol, α,ω-polybutadienedicarboxylic acid, maleic polybutadiene, terminal acryl denatured polybutadiene and terminal half ester denatured polybutadiene etc. can be given as a preferable one and these can be used either independently or in combination thereof.

Any of these polybutadiene prepolymers has, from its own structural feature, a nature of polyolefin and therefore toners obtained therefrom are given an anti-coking property.

Such reactive prepolymers are to be contained in polymeric composed substance within a range of 1–40% in weight and preferably 5–20% in weight against polymeric monomers.

Further in the present invention, it is preferable to use a low molecular polyolefin for the purpose of further improving the anti-offset property of the toner. As the low molecular polyolefin compound, those having relatively low melting point and a average molecular weight of 1,000 to 45,000, preferably 2,000 to 6,000 can be mentioned. Especially those having softening point of 100° to 180° C., and more preferably, 130° to 160° C. can suitably be used.

As concrete examples of such polyolefin, polyethylene, polypropylene, polybutylene or the like can be given and among these, polypropylene is particularly preferable.

In low molecular polyolefin to be used for the prevention of offset in the present invention, low molecular olefin copolymer is included. Such low molecular olefin copolymer is an olefin copolymer wherein only olefin is contained as monomer component, or is an olefin copolymer wherein the one other than olefin is contained as monomer component and the molecular weight thereof is relatively small.

Olefin as monomer component includes, ethylene, propylene, butene-1, pentene-1, hexene-1, heptene-1, octene-1, nonene-1 and decene-1, and their isomer wherein the position of unsaturated bond is different for example and 3-methyl-1-butene, 3-methyl-2-pentene, 3-propyl-5-methyl-2-hexene etc. having brach chains made of alkyl group for example and all other olefins therein.

As a monomer other than olefin that makes up copolymer together with olefin, vinylether such as vinylmethylether, vinyl-n-butylether and vinylphenylether etc. for example, vinylester such as vinylacetate and vinylbutylate for example, haloolefins such as vinyl fluoride, vinylidene fluoride, tetrafluoroethylene, vinyl chloride, vinylidene chloride and tetrachloroethylene etc. for example, ester acrylate or ester methacrylate such as methylacrylate, ethylacrylate, n-butylacrylate, methylmethacrylate, ethylmethacrylate, n-butylmethacrylate, stearylmethacrylate, N,N-dimethylaminoethylmethacrylate and t-butylaminoethylmethacrylate etc. for example, derivative acrylate such as acrylonitrile and N,N-dimethylacrylamide etc. for example, organic acid such as acrylic acid, methacrylic acid, maleic acid, fumaric acid, itaconic acid etc., and various other compound such as diethylefumarate and β-pinene can be mentioned.

Consequently, low molecular olefin copolymer that can be used in the present invention as low molecular polyolefin includes olefin copolymer made of only olefin that contains at least 2 kinds of above-mentioned olefin as monomer component, such as ethylene-propylene copolymer, ethylene-butene copolymer, ethylene-pentene copolymer, propylene-butene copolymer, propylene-pentene copolymer, ethylene-3-methyl-1-butene copolymer and ethylene-propylene-butene copolymer etc. for example, or olefin copolymer containing at least one kind of above-mentioned olefin and at least one kind of monomer other than above-mentioned olefin as monomer conponent such as ethylene-vinylacetate copolymer, ethylene-vinylmethylether copolymer, ethylene-vinyl chloride copolymer, ethylene-methylacrylate copolymer, ethylene-methylmethacrylate copolymer, ethylene-acrylic acid copolymer, propylene-vinylacetate copolymer, propylene-vinylethylether copolymer, propylene-ethylacrylate copolymer, propylene-methacrylic acid copolymer, butene-vinylmethylether copolymer, butene-methylmethacrylate copolymer, pentene-vinylacetate copolymer, hexene-vinylbutylate copolymer, ethylene-propylene-vinylacetate copolymer and ethylene-vinylacetate-vinylmethylether copolymer etc. for example.

In case of olefin copolymer containing monomer other than olefin as its monomer component among low molecular olefin copolymer mentioned above, the one containing much olefin component therein is preferable. The reason for this is that in such copolymers, the releasing property is generally low, causing less effect as an offset prevention agent when the containing amount of olefin is small and there is a tendency that the characteristics such as fluidity and image forming property etc. of the toner obtained are deteriorated. Therefore, in case of aforesaid copolymers, the one containing much olefin is more desirable and particularly the one containing olefin component of more than about 50 mol % is advantageous as an offset prevention agent to be used in the present invention.

When using polyolefin having its average molecular weight of less than 1,000, the softening point of toners being obtained thereby is lowered and cohesion of toner grains is apt to occur and accordingly, stains on photosensitive substance or carrier become more serious when the aforesaid toners are applied to electrophotographic process, and on the other hand, when the average molecular weight thereof is over 45,000, the softening point of toners thus obtained becomes too high, so that it is impossible to obtain an offset prevention effect successfully.

Polyolefin serving as the abovementioned offset preventive is to be used at the ratio of 1–20 parts by weight, preferably 3–15 parts by weight against 100 parts of monomers of polymerized composite. When the ratio is less than 1 part by weight, the offset prevention effect becomes insufficient and unreliable, and when over 20 parts thereof, the fluidity of the toners thus obtained will become lower.

Further in the present invention, metallic salts of fatty acid such as zinc salt, barium salt, lead salt, cobalt salt, calcium salt and magnesium salt of stearic acid; zinc salt, manganese salt, iron salt and lead salt of oleic acids; and zinc salt, cobalt salt and magnesium salt of palmitic acids; and, higher fatty acids having more than 17 carbon atom numbers, higher alcohols having the same as above, esters of polyhydric alcohol, natural or synthesized paraffins, fatty acid esters and the partially saponified matters thereof, alkylene bis fatty acid amido such as ethylene bis stearoylamido, and other matters effective for offset prevention, can be used jointly with the aforesaid polyolefins having a low molecular weight.

As for the coloring agents to be used for the present invention, any suitable pigment or dye may optionally be used, for example, they are given as carbon black, nigrosine dye (C.I. No. 50415B), aniline blue (C.I. No. 50405), chalcoil blue (C.I. No. azoee blue 3), chrome yellow (C.I. No. 14090), ultramarine blue (C.I. No. 77103), Du Pont oil red (C.I. No. 26105), Orient oil red #330 (C.I. No. 60505), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), rose bengal (C.I. No. 45435), oil black and azo oil black, each of which may be used singly or by mixing with each other. The coloring agents may be held in toners which are as the ultimate product, at such a ratio that the coloring agent can be held in at about 3–20% by weight of the toner. And in the case that magnetic powders of which are described hereinafter are to be utilized, the magnetic powders may be utilized as a coloring agent.

As for polymerizing initiators which may be used for the present invention, any of ordinary use may be utilized within appropriate temperature range. As the examples, benzoyl peroxide, 2,2'-azobisisobutylonitrile, 2,2'-azobis-(2,4-dibutylvaleronitrile), lauryl peroxide, orthochloro benzoyl peroxide and orthomethoxy benzoyl peroxide can be mentioned.

In the present invention, the polymerization can be effected under either ordinary of high pressure.

Further in the present invention, a so-called "single-component" type magnetic toner may also be obtainable by incorporating in the polymer component of the toner suitable magnetic substances. The magnetic substance in this invention means a substance which is capable of being strongly magnetized in a magnetic field and which, more preferably, is black and is chemically stable. In the present invention it is preferable that the magnetic substance is in the form of fine powder having the average grain size of less than 1 micron, and in the above-mentioned respects magnetite (triiron tetraoxide) is most preferable. As examples of such magnetic substances, metals such as cobalt, iron and nickel; metallic alloys or mixtures of, for example, aluminium, cobalt, copper, iron, magnesium, nickel, tin, zinc, antimony, berylium, bithmuth, cadmium, calcium, manganese, selenium, titanium, tungsten and vanadium; metallic compound including metal oxide such as aluminium oxide, iron oxide, copper oxide, nickel oxide, zinc oxide, titanium oxide and magnesium oxide; refractory nitride such as vanadium nitride and chromium nitride; carbide such as silica carbide; and ferrite and a mixture thereof can be mentioned. It is preferable that fine powder of the aforementioned magnetic substance have the average grain diameter of 0.01 to 1 micron. The magnetic substance may be incorporated into the toner at the proportion of 50 to 300 parts by weight based on 100 parts by weight of polymer component of the toner, preferably 50 to 200 parts by weight, and particularly, 90 to 150 parts by weight based on the polymer component of the toner. The magnetic substance can either be present at the time of polymerization of the monomer of the present invention or be added to the polymer component after the polymerization, i.e., during fusing or kneading step.

As for the resins to form a resin coated layer in the invention, any arbitrary resin can be used, among those of which the preferable ones are given, as the examples, styrene resins such as [A-75], [D-75], [D-100], [D-125] and [D-150] which are being marketed under the brand name of [Piccolastic] by ESSO Standard Oil Co., olefin hydrocarbon resins such as [70], [85] and [100] which are being marketed under the brand name of [Piccopale] by ESSO Standard Oil Co.; terpene resins such as [#400]-[#1150] which are being marketed under the brand name of [YS Resin Px] by Yasuhara Ushi Kogyo Co., and β-pinene resin; aromatic hydrocarbon resins such as [#80]-[#150] which are being marketed under the brand name of [Petrodine] by Mitsui Petrochemical Ind. Co., and the resins being marketed under the brand names of [Piccopar -AP- 10] and [Transfalt L-4] by ESSO Standard Oil Co.

The percentage by weight of the above resins for forming coated layers to toners in the aggregate is 0.5–10% by weight, desirably 2–5% by weight.

And, as for the solvents to prepare said resins for forming coated layers, any solvent can be used if it is hard soluble against nuclear particles for toner use, and there are usually used, for concrete example, n-hexane, isohexane, n-pentane, n-octane and isooctane as to aliphatic hydrocarbon solvents; [Isopar H], [Isopar G] and [Isopar E] as to isoparaffin hydrocarbon solvents. The amount of each of said solvents to be used may normally be equivalent to the amount by weight of nuclear particles to be used.

And, as for hydrophobic silica fine powders, [Aerosil R-972] (mfd. by Japan Aerosil Co.) can be given as a suitable one, and the percentage thereof to be contained in a coated layer is within the range of 0.1–10% by weight, preferably 1–5% by weight to toners in the aggregate.

The present invention is as above described and, as is obvious from the examples and the description thereof hereinafter referred to, the toners relating to the invention have excellent frictional chargeability and humidity resisting property. And, toner having desired characteristics can be obtained by suitably changing not only the kinds of said resins but also the ratio of contents of resins to that of solvent.

And, more remarkable improvements on humidity resisting property and negative frictional chargeability can be achieved by making use of a resin solution wherein hydrophobic silica was uniformly dispersed. In addition to the above, said hydrophobic silica is fixed onto toner grains, therefore, the abovementioned characteristics are displayed stably.

And, by adding cross-linking agent, reactive prepolymer, low molecular weight polyolefin etc. into a polymeric composite, it is possible to further give excellent offset resisting property and fixing property to a heat-roller type fixation system.

Further, in the case that toners of the invention were mixed with carriers and then used as a component of so-called binary component developer, no special property is required to said carriers; and in the case that magnetic substance contains therein, they can be used as single component toners, as they are.

The following are the description of the examples of the invention on the condition that it is to be understood that the invention is not limited to the specific examples thereof. For reference, the term, "part(s)" represents part(s) by weight.

Example 1 of nuclear particle preparation:

| | |
|---|---|
| Styrene | 90 parts |
| n-butylacrylate | 10 parts |
| [Carbon Black #2300] (mfd. by Mitsubishi Kasei Kogyo Co.) | 5 parts |
| Diethylaminoethyl methacrylate | 0.8 parts |
| 2,2'-azobis-(2,4-dimethylvaleronitrile) | 0.4 parts |

A polymeric composite was prepared by mixing and dispersing the above matters. On the other hand, 0.8 parts of [Aerosil 200], colloidal silica, were taken into a separable flask having capacity of 2 l and distilled water was added therein, and, said polymeric composite was further added therein, and the thusly obtained solution was heated up to the temperature of 65° C. with agitation at 3,000 r.p.m. by making use of [TK Homomixer], an agitating machine, (mfd. by Tokushu Kika Kogyo Co.) and the same temperature was maintained. The grain diameter of the dispersive grains was within the range of 10–15 microns at the time when heated for 30 minutes. Thereafter, the polymeric reaction proceeded for six hours with agitation at 100 r.p.m. by making use of a normal type of agitating machine, and the polymerization was then completed, however no change of the grain diameter was observed. Thus, the dispersive solution A has been obtained, wherein nuclear particles for toner use were dispersed.

Example 2 of nuclear particle preparation:

| | |
|---|---|
| Styrene | 70 parts |
| Methyl methacrylate | 20 parts |
| n-butyl methacrylate | 10 parts |
| [Mitsubishi Carbon Black MA-600] (mfd. by Mitsubishi Kasei Kogyo Co.) | 5 parts |
| Lauroyl peroxide | 2 parts |

A polymeric composite was prepared by mixing and dispersing the above matters. On the other hand, 1.00% by weight of polyvinyl alcohol solution was taken into a separable flask having capacity of 2 l and said polymeric composite was added therein, and the thusly obtained solution was heated up to the temperature of 65° C. with agitation at 3,000 r.p.m. by making use of [TK Homomixer] (mfd. by Tokushu Kika Kogyo Co.), an agitating machine, and the same temperature was maintained. The grain diameter of the dispersive grains was observed within the range of 10–15 microns at the time when heated for 30 minutes. Thereafter, the polymeric reaction proceeded for six hours with agitation at 100 r.p.m. by making use of a normal type of agitating machine, and the polymerization was then completed, however, no change of the grain diameter was observed. Thus, the dispersive solution B wherein nuclear particles for toner use have been obtained.

Example 3 of nuclear particle preparation:

| | |
|---|---|
| Methyl methacrylate | 100 parts |
| Triiron tetraoxide powder, [Mapico Black BL-100] (mfd. by Titan Kogyo Co.) | 60 parts |
| Triiron tetraoxide powder, [Toda Color EPT-1000] (mfd. by Toda Kogyo Co.) | 40 parts |
| Dicoco amine (cationic hard water soluble amine) | 1.2 parts |

-continued

| | |
|---|---|
| Azobisisobutylonitrile | 1 part |

A polymeric composite was prepared by mixing and dispersing the above matters. On the other hand, 1.2 parts of [Aerosil Mox 700], colloidal silica, to be served as anionic inorganic dispersing agent, were taken into a separable flask having capacity of 2 l and distilled water was added therein, and said polymeric composite was further added therein, and the thusly obtained solution was heated up to the temperature of 80° C. with agitation at 3000 r.p.m by making use of [TK Homomixer], an agitating machine, (mfd. by Tokushu Kika Kogyo Co.), and the same temperature was maintained. The grain diameter of the dispersive grains was observed within the range of 10–15 microns at the time when heated for 3 minutes. Thereafter, the polymeric reaction proceeded for six hours with agitation at 100 r.p.m. by making use of a normal type of agitating machine, and the polymerization was then completed, however, no change of the grain diameter was observed. Thus the dispersion solution C, wherein nuclear particles for toner use were dispersed, has been obtained.

After the completion of polymerization, solid particles were filtrated and dried and the nuclear particle powder C with an average grain diameter of 13 microns was obtained.

EXAMPLE 1

Aromatic hydrocarbon resin "Petrodin #150" (made by Mitsui Sekiyu Kagaku Kogyo Co., Ltd.) in the amount of 8 parts was added in 100 parts of n-pentane and was stirred and dissolved at the room temperature and to the resin solution thusly obtained, aforesaid nuclear particle powder A for toner in the amount of 100 parts was added while stirring and was further stirred fully until the contents were mixed uniformly. After that, by drying with air, this mixture in the slurry state at the room temperature, 2-component toner with an average grain diameter of 13 microns was obtained.

Using the developer prepared by mixing 5 parts of this toner with 95 parts of "iron powder carrier DSP" (made by Dowa Teppun Kogyo Co., Ltd.), the image forming was made on the electronic copier "U-Bix V": (made by Konishiroku Photo Ind. Co., Ltd.) and clear images were obtained.

The volume specific resistance rate of this toner was measured and the value of $2\times10^{15}$ Ω.cm which is high was obtained.

EXAMPLE 2

"Petrodin #150" in the amount of 8 parts was added to 100 parts of n-pentane and was stirred and dissolved, at the room temperature and to the resin solution thusly obtained, 5 parts of the fine powder of hydrophobic silica "aerosil R-972" was added while stirring and they were stirred fully for the uniform dispersion. To this dispersion liquid, 100 parts of aforesaid nuclear particle powder for toner was added while stirring and they were fully stirred until the contents thereof were uniformly mixed. After that, by drying with air, this mixture in the slurry state at the room temperature, 2-component toner with an average grain diameter of 13 microns was obtained.

The developer wherein this toner is contained was prepared in the same manner as example 1 and the same image forming was made and clear reproduced images were obtained. Further, the volume specific resistance rate of this toner was $4\times10^{15}$ Ω.cm which is high and the charging amount of aforesaid developer was measured with a blow-off method and the satisfactory value of −22 micro coulombs/g was obtained. Further, the continuous copying of 20,000 times was made using this developer and clear reproduced images similar to that in the initial stage of copying were obtained. The charging amount at this time was −20 micro coulombs/g that was almost the same as the one in the initial stage.

EXAMPLE 3

In 120 parts of n-hexan, 1 part of olefin hydrocarbon resin "Piccopale 100" (made by ESSO Standard Oil Co., Ltd.) was added and was stirred and dissolved at the room temperature and to the resin solution thusly obtained, 100 parts of nuclear particle powder B for toner was added while stirring and they were fully stirred until the contents were uniformly mixed. After that, by drying this mixture in the slurry state at 50° C. under the decompressed state, 2-component toner with an average grain diameter of 13 microns was obtained.

Using the developer prepared by mixing 5 parts of this toner with 95 parts of "iron powder carrier DSP" (made by Dowa Teppun Kogyo Co., Ltd.), the image forming was made on the electronic copier "U-Bix V" (made by Konishiroku Photo Ind. Co., Ltd.) and clear images were obtained. Further, the volume specific resistance rate of this toner was measured and the high value of $1\times10^{15}$ Ω.cm was obtained.

EXAMPLE 4

In 120 parts of n-hexan, 1 part of "Piccopale 100" was added and was stirred and dissolved at the room temperature and to the resin solution thusly obtained, 0.3 parts of hydrophobic silica fine powder "aerosil R-972" was added while stirring and the uniform dispersion was obtained by the stirring with the number of revolution of 3000 r.p.m. produced by a stirrer "TK Homomixer" (made by Tokushu Kika Kogyo Co. Ltd.). To this dispersion liquid, 100 parts of nuclear particle powder B for toner was added while stirring and they were fully stirred until the contents were uniformly mixed. After that, by drying this mixture in the slurry state at 50° C. under the decompressed state, 2-component toner with an average grain diameter of 13 microns was obtained.

With the use of this toner, the developer was prepared in the same manner as example 3 and the same image forming was made and clear reproduced images were obtained. Further, the volume specific resistance rate of this toner was as high as $3\times10^{15}$ Ω.cm and charging amount of aforesaid developer was measured by a blow-off method and the satisfactory value of −20 micro coulombs/g was obtained. Further, the continuous copying of 20,000 times was made using this developer and clear reproduced images similar to that in the initial stage of copying were obtained. The charging amount at this time was −19 micro coulombs/g that was almost the same as the one in the initial stage.

EXAMPLE 5

To 100 parts of isoparaffin hydrocarbon solvent "Isopar G" (made by ESSO Chemical Co.), 3 parts of terpene resin "YS resin Px #600" (made by Yasuhara Yushi Kogyo Co.) was added and was stirred and dissolved at the room temperature and to the resin solution thusly obtained, 100 parts of nuclear particle powder C for toner was added while stirring and they were fully stirred until the contents were uniformly mixed. After that, by adding 100 parts of "Isopar G" to this mixture in the slurry state and by spray drying with a spray drier, single component toner with an average grain diameter of 13 microns was obtained.

The image forming was made on the remodeled machine of the electronic copier "U-Bix V" (made by Konishiroku Photo Ind. Co., Ltd.) using this toner as a developer and clear images without any grey background were obtained.

EXAMPLE 6

To 100 parts of "Isopar G", 3 parts of "YS resin Px #600" was added and was stirred and dissolved at the room temperature and to the resin solution thusly obtained 2 parts of hydrophobic silica fine powder "aerosil R-972" was added while stirring and they were fully stirred for uniform dispersion thereof. To this dispersion liquid, 100 parts of nuclear particle powder for toner was added while stirring and they were fully stirred until the contents were uniformly mixed. After that, 100 parts of "Isopar G" was further added to this mixture in the slurry state and by spray drying with a spray drier, single component toner with an average grain diameter of 13 microns was obtained.

Using this toner as a developer, the image forming was made in the same manner as example 5 and clear images without any grey background were obtained.

EXAMPLE 7

The dispersion solution A of said nuclear particles for toner use was heated and kept its temperature at 65° C.–75° C., and therein five parts of "Kayakalan Black 2RL" (mfd. by Nippon Kayaku Co., C.I. Acid Black 155) were added and dissolved under agitation, and 25 parts of acetic acid were further added therein and agitated for twenty minutes, and thereafter the obtained solution was cooled down to room temperature and then solid matters were filteratedly divided therefrom. Thus obtained liquid was transparent. Then the filterated grains in shape of wet-cake like were dried at reduced pressure at the temperature of 50° C., and thus, the dyed grains have geen obtained.

On the other hand, 8 parts of "Petrodin #150" (mfd. by Mitsui Petrochemical Co.), a kind of aromatic hydrocarbon resins, were added into 100 parts of n-pentane and then dissolved therein with agitation at room temperature, and 100 parts of said dyed grains were added into the thusly obtained resin solution under agitation, and agitation was fully kept on until the contents were uniformly mixed with each other. After then, binary component toner having the average grain diameter of 13 microns has been obtained by air-drying said slurry mixture at room temperature.

When an image formation was tried by making use of a developer which was prepared by mixing five parts of said toner with 95 parts of "Iron Powder Carrier DSP" (mfd. by Dowa Iron Powder Kogyo Co.) on an electrophotographic copier "U-Bix V" (mfd. by Konishiroku Photo Ind. Co., Ltd.), a sharp and clear-cut image has been obtained.

When the intrinsic volume resistivity of the toner was measured, the high value of $8\times10^{15}$ Ω.cm has been observed. Further, when a charged volume of said developer was measured through the blow-off method, the volume was observed at −23 micro coulomb/g that is excellent.

EXAMPLE 8

The dispersion solution A of said nuclear particles for toner use was heated and kept the temperature thereof at 65°–70° C. and five parts of "kayakalan Black 2RL" (mfd. by Nippon Kayaku Co., C.I. Acid Black 155) were added and dissolved with agitation into said solution A, and 25 parts of acetic acid were added therein and agitated for 20 minutes, and then cooled down to room temperature and filterated to devide solid matters. Thus obtained filterated liquid was transparent. Then the filterated grains in shape of wet-cake like were dried up at reduced pressure at the temperature of 50° C. and, thus, the dyed grains have been obtained.

On the other hand, eight parts of "Petrodin #150" were added into 100 parts of n-pentane and dissolved therein with agitation at room temperature and five parts of fine powder of hydrophobic silica "Aerosil R-972" were added with agitation into the thusly obtained resin solution and then fully agitated and dispersed uniformly. And, 100 parts of said dyed grains were added with agitation in the dispersion solution and full agitation was made until the contents have been uniformly mixed altogether. After then, binary component toner having the average grain diameter of 13 microns has been obtained by air-drying said slurry mixture at room temperature.

By making use of said toner, a developer was prepared in the similar process to that in Example 1, and when an image formation was tried by the use of said developer, a sharp and clear-cut image has been obtained. And the intrinsic volume resistivity of the toner was so high as $6\times10$ (15) OHM.CM and, in addition, when a charged volume of said developer was measured through the blow-off method, the volume was observed at −28 micro coulomb/g that is excellent. Besides, when a continuous copying of 20,000 times was tried by the use of said developer, a sharp and clear-cut copied image has been obtained equivalent to that made at the initial copying stage of the copying operation. The charged volume at this time was observed at −27 micro coulomb/g that has remained almost unchanged as was the initial stage thereof.

EXAMPLE 9

The dispersion solution B of said nuclear particles for toner use was added and dissolved with agitation by 3.4 parts of "Cibalan Black BGL" (mfd. by Ciba Geigy S.A., Switzerland, C.I. Acid Black 107) and 17 parts of acetic acid were added thereinto and heated, and kept its temperature at 60°–65° C. and agitated for 30 minutes, and then cooled down to room temperature, and a filteration was made to devide solid matters therefrom. The filterated solution was transparent. The filterated grains in shape of wet-cake like were dried up at reduced pressure at the temperature of 50° C., and thus, the dyed grains have been obtained.

On the other hand, one part of "Piccopale" (mfd. by ESSO Standard Oil Co.), a kind of olefin hydrocarbon resins, was added into 120 parts of n-hexane and agitating and dissolving were made therein at room temperature, and thus, the resin solution was obtained, and then 100 parts of said dyed grains were added with agitation into the obtained resin solution, and agitation was kept fully on until the contents of the solution were uniformly mixed. Thereafter, the binary component toner having the average grain diameter of 13 microns has been obtained by drying the slurry mixture at reduced pressure and at 50° C.

When an image formation was tried by making use of the developer which had been prepared by mixing five parts of thus obtained toners in 95 parts of "Iron Powder Carrier, DSP" (mfd, by Dowa Iron Powder Kogyo Co.) and on an electrophotographic copying machine, "U-Bix V" (mfd, by Konishiroku Photo Ind. Co., Ltd.), a sharp and clear-cut copy has been obtained. And, when measured the intrinsic volume resistivity of the toner, the high value has been observed as $1\times10^{15}$ Ω.cm Further, when measured the charged volume of said developer through the blow-off method, the volume was observed excellently at −22 micro coulomb/g.

EXAMPLE 10

"Cibalan Black BGL" (mfd, by Ciba Geigy, Switzerland, C.I. Acid Black 107) of 3.4 parts were dissolved with agitation in the dispersion solution B of said nuclear particles, and 17 parts of acetic acid were added and heated, and agitated for 30 minutes with keeping the temperature thereof at 60°-65° C., and then cooled down to room temperature, and thus, solid matters have been filterated to devide. the filterated solution has been transparent. Then, the filterated grains in shape of wet-cake like were dried up at reduced pressure at 50° C., and thus dyed grains have been obtained.

On the other hand, one part of "Piccopale 100" was added in 120 parts of n-hexane and, agitated and dissolved at room temperature, and then 0.3 part os "Aerosil R-972", hydrophobic silica fine powders, was added with agitation into thus obtained resin solution and agitated by an agitating machine "TK Homomixer" (mfd. by Tokushu Kika Kogyo Co.) at 3,000 r.p.m., and dispersed uniformly. Into the thusly obtained dispersive solution, 100 parts of said dyed grains were added with keeping agitation fully until the contents of the solution were uniformly mixed. Thereafter, thus obtained slurry mixture were dried up at reduced pressure at 50° C., and thus, binary component toners having the average grain diameter of 13 microns have been obtained.

A developer was prepared by making use of said toners and in the similar process to that in Example 3, and when an image formation was tried similarly by the use of said developer, a sharp and clear-cut image has been obtained. And, the intrinsic volume resistivity of the toner was observed as high as $3\times10^{15}$ Ω.cm, and in addition, when measured the charged volume of said developer through the blow-off method, the excellent volume has been observed at −27 micro coulomb/g. Further, when a continuous copying operation of 20,000 times was tried by making use of said developer, a sharp and clear-cut copied image has been obtained equivalent to that made at the initial stage of the copying operation. And the charged volume observed at that time was at −26.5 micro coulomb/g which remained almost unchanged as was at the initial stage thereof.

EXAMPLE 11

The dispersive solution C of said nuclear grains was heated to keep the temperature at 55°-60° C. and one part of "Aizen Opal Black BNH" (mfd. by Hodogaya Kagaku Kogyo Co., C.I. Acid Black 118) was added and dissolved therein with agitation, and five parts of acetic acid were added and agitated for ten minutes and then cooled down to room temperature, and thus, solid matters have been filterated to devide. The filterated solution has been transparent. The filterated grains in shape of wet-cake like were heated up to the temperature of 50° C. and air-dried up, and thus, dyed grains have been obtained.

On the other hand, three parts of "YS Resin Px #600" (mfd. by Yasuhara Yushi Kogyo Co.), a kind of terpene resins, were added into 100 parts of "Isopar G" (mfd. by ESSO Chemical Co.), isoparaffin hydrocarbon solvent, and, agitation and dissolution thereof were made at room temperature, and 100 parts of said dyed grains were added with agitation into the thusly obtained resin solution, and then agitation was fully made until the contents of the solution were uniformly mixed. Thereafter, 100 parts of "Isopar G" were further added into the thusly obtained slurry mixture and mist-dried by making use of a spray drier, and thus, single component toner having the average grain diameter of 13 microns has been obtained.

By making use of said toner as a developer and of an electrophotographic copying machine "a remodeled U-Bix V" (mfd. by Konishiroku Photo Ind. Co., Ltd.), an image formation was tried, then a fogless and sharp image has been obtained.

EXAMPLE 12

The dispersive solution C of said nuclear grains was heated up and kept the temperature at 55°-60° C., and one part of "Aizen Opal Black BNH" (mfd. by Hodogaya Kagaku Kogyo Co., C.I. Acid Black 118) was added and dissolved with agitation, and five parts of acetic acid were added therein and agitated for ten minutes and then cooled down to room temperature, and thus, solid matters have been filterated to devide therefrom. The filterated solution has been transparent. And the filterated toner grains in shape of wet-cake like were air-dried up at the temperature of 50° C., and thus, dyed grains have been obtained.

On the other hand, three parts of "YS Resin Px #600" were added into 100 parts of "Isopar G", and agitated and dissolved at room temperature, and two parts of "Aerosil R-972", hydrophobic, silica fine powders, were added with agitation into the thusly obtained resin solution, and a uniform dispersion was made by a full agitation thereof. And, said dyed grains of 100 parts were then added with agitation into said dispersive solution, and a full agitation was made until the contents of the solution were uniformly mixed. Thereafter, 100 parts of "Isopar G" were further added into thus obtained slurry mixture and a mist-drying was made by making use of a spray drier, and thus, single component toners having the average grain diameter of 13 microns have been obtained.

By making use of said toners as a developer and of the similar process to that in Example 5, an image formation was tried, and thus, a fogless and sharp image has been obtained therefrom.

COMPARISON EXAMPLE 1

Using the developer prepared by mixing 5 parts of nuclear particle powder A for toner with 95 parts of "iron powder carrier DSP" (made by Dowa Teppun Kogyo Co.), the image forming was made on the electronic copier "U-Bix V" (made by Konishiroku Photo Ind. Co., Ltd.) and the images obtained had a remarkable grey background. Further, the volume specific resistance rate of this toner was as low as $5\times10^{8}$ Ω.cm and the charging amount of aforesaid developer was as low as −2 micro coulombs/g.

COMPARISON EXAMPLE 2

Using the developer prepared by mixing 5 parts of nuclear particle powder B for toner with 95 parts of "iron powder carrier DSP" (made by Dowa Teppun Kogyo Co. Ltd.), the image forming was made on tne electronic copier "U-Bix V" (made by Konishiroku Photo Ind. Co., Ltd.) and images obtained therefrom had a remarkable grey background. Further, the volume specific resistance rate of this toner was as low as $2\times10^9$ Ω.cm and the charging amount of aforesaid developer was as low as −3 micro coulombs/g.

COMPARISON EXAMPLE 3

By making use of a developer which was prepared by mixing five parts of the powders which had been isolated from the dispersive solution A of the nuclear grains for toner use with 95 parts of "Iron Powder Carrier DSP" (mfd. by Dowa Iron Powder Kogyo Co.), and also by making use of an electrophotographic copying machine, "U-Bix V" (mfd, by Konishiroku. Photo Ind. Co., Ltd.), an image formation was tried, and the thusly obtained image has had a remarkable fog. And, the intrinsic volume resistivity of the toner has been as low as $5\times10^8$ Ω.cm, and, in addition, the charged volume of said developer has also been as low as −2 micro coulomb/g.

COMPARISON EXAMPLE 4

By making use of a developer which was prepared by mixing five parts of the powders which had been isolated from the dispersive solution B of the nuclear grains for toner use with 95 parts of "Iron Powder Carrier DSP" (mfd. by Dowa Iron Powder Kogyo Co.) and also by making use of an electrophotographic copying machine "U-Bix V" (mfd, by Konishiroku Photo Ind. Co., Ltd.), an image formation was tried, and the thusly obtained image has had a remarkable fog. And, the intrinsic volume resistivity of the toner has been as low as $2\times10^9$ Ω.cm, and in addition, the charged volume of said developer has also been as low as −3 micro coulomb/g.

We claim:

1. A toner for developing electrostatically charged images comprising colorant-containing nuclear particles formed by polymerization, hydrophobic silica, and a resin, wherein said resin is coated on the surface of said nuclear particles and said silica is dispersed in said resin surface coating.

2. The toner of claim 1, further comprising hydrophobic silica contained in said resin coated layer wherein the ratio if hydrophobic silica contained in aforesaid resin coated layer to total toner is 0.1 to 10 weight %.

3. The toner of claim 1 wherein said nuclear particles have diameters of 1 to 50 microns.

4. The toner of claim 1 wherein said nuclear particles are cross linked in the presence of at least of a cross linking agent and a pre-polymer.

5. The toner of claim 1 wherein said resin is at least one selected from the group consisting of styrene, olefin hydrocarbon, terpine and non-styrene aromatic hydrocarbon resins.

6. The toner of claim 1 wherein said resin is present, based upon said toner, in an amount of 0.5 to 10 w/w %.

7. The toner of claim 1 further comprising a dye wherein said dye is present on the surface of said nuclear particles.

8. The toner of claim 7, further comprising hydrophobic silica contained in said resin coated layer wherein the precentage by weight of hydrophobic silica contained in said resin coated layer to the toner in the aggregate is 0.1 to 10%.

9. The toner of claim 7 wherein said nuclear particles have a diameter of 1 to 50 microns.

10. The toner of claim 7 wherein said nuclear particles are cross linked in the presence of at least one of a cross linking agent and a pre-polymer.

11. The toner of claim 7 wherein said resin is at least one selected from the group consisting of styrene, olefin hydrocarbon, terpine and non-styrene aromatic hydrocarbon resins.

12. The toner of claim 7 wherein said resin is present, based upon said toner, in an amount of 0.5 to 10 w/w %.

13. The toner of claim 7 wherein said dyes are acidic or basic.

14. The toner of claim 7 wherein said dyes are present, based upon said toner, in an amount of 0.1 to 5 w/w %.

15. A method for producing a toner for developing electrostatically charged images comprising polymerizing colorant-containing nuclear particles, dissolving a resin in the solvent which exerts a lesser solvating action against said nuclear particles than against said resin to form a solution, dispersing hydrophobic silica in said solution, mixing said nuclear particles with said dispersion to form a silica-containing outer coating, and drying said mixture.

16. The method of claim 15 wherein said solvent is an aliphatic hydrocarbon or isoparaffin solvent.

17. The method of claim 15 further comprising dispersing a dye in an aqueous medium, agitating said dye dispersion in the presence of said nuclear particles resulting in dyed particles, and drying said dyed particles prior to said mixing step.

18. The method of claim 17 wherein said solvent is an aliphatic hydrocarbon or isoparaffin solvent.

* * * * *